US009315371B2

(12) United States Patent
Orita

(10) Patent No.: US 9,315,371 B2
(45) Date of Patent: Apr. 19, 2016

(54) WATER DISPENSER

(75) Inventor: Yoshinori Orita, Kakogawa (JP)

(73) Assignee: KABUSHIKI KAISHA COSMO LIFE, Hyogo (JP)

( * ) Notice: Subject to any disclaimer, the term of this patent is extended or adjusted under 35 U.S.C. 154(b) by 0 days.

(21) Appl. No.: 14/370,070

(22) PCT Filed: Jul. 2, 2012

(86) PCT No.: PCT/JP2012/066860

§ 371 (c)(1),
(2), (4) Date: Jul. 1, 2014

(87) PCT Pub. No.: WO2013/103026

PCT Pub. Date: Jul. 11, 2013

(65) Prior Publication Data

US 2014/0339261 A1 Nov. 20, 2014

(30) Foreign Application Priority Data

Jan. 6, 2012 (JP) ..... 2012-001291

(51) Int. Cl.
*B67D 3/00* (2006.01)

(52) U.S. Cl.
CPC ..... *B67D 3/0009* (2013.01); *B67D 3/0022* (2013.01); *B67D 3/0025* (2013.01); *B67D 3/0038* (2013.01); *B67D 3/0061* (2013.01)

(58) Field of Classification Search
CPC .. B67D 3/0009; B67D 3/0061; B67D 3/0038; B67D 1/0009; B67D 3/0025; B67D 3/0022
USPC ..... 222/146.6, 129, 564; 62/390
See application file for complete search history.

(56) References Cited

U.S. PATENT DOCUMENTS 3,088,289 A * 5/1963 Alex ..... 62/3.64
3,250,433 A 5/1966 Christine et al.

(Continued)

FOREIGN PATENT DOCUMENTS

JP 63-190880 12/1988
JP 4-135497 12/1992

(Continued)

OTHER PUBLICATIONS

International Search Report issued Sep. 25, 2012 in International (PCT) Application No. PCT/JP2012/066860.

(Continued)

*Primary Examiner* — Kevin P Shaver
*Assistant Examiner* — Robert Nichols, II
(74) *Attorney, Agent, or Firm* — Wenderoth, Lind & Ponack, L.L.P.

(57) ABSTRACT

A water dispenser includes a baffle which interferes with the downward flow of water introduced into a cold water tank through a water supply line. The baffle has a water transfer passage formed by a downwardly recessed surface portion formed on the top surface of the baffle and having a distal edge, and an edge portion having a predetermined thickness and located over the distal edge so as to overlap the distal edge. The water transfer passage is configured such that the recessed surface portion deflects the flow of water flowing down through the water transfer passage in a horizontal direction or a direction close to a horizontal direction. Water is thus discharged from the terminal end opening defined by the distal edge and the edge portion into the lower portion of the cold water tank in a direction close to a horizontal direction.

2 Claims, 6 Drawing Sheets

(56) References Cited

U.S. PATENT DOCUMENTS

| | | | | |
|---|---|---|---|---|
| 4,597,509 | A * | 7/1986 | Pereira | 222/129 |
| 4,651,862 | A * | 3/1987 | Greenfield, Jr. | 194/344 |
| 4,958,747 | A * | 9/1990 | Sheets | 222/67 |
| 5,667,103 | A * | 9/1997 | Donselman et al. | 222/129 |
| 5,678,734 | A * | 10/1997 | Walker | 222/146.5 |
| 5,862,669 | A | 1/1999 | Davis et al. | |
| 7,422,684 | B1 * | 9/2008 | Davis | C02F 1/78 210/192 |
| 2004/0226313 | A1 | 11/2004 | Busick | |
| 2010/0212333 | A1 * | 8/2010 | Moon | B67D 1/0009 62/85 |
| 2012/0000861 | A1 | 1/2012 | Shiotani et al. | |

FOREIGN PATENT DOCUMENTS

| | | |
|---|---|---|
| JP | 2000-085893 | 3/2000 |
| JP | 2001-341798 | 12/2001 |
| JP | 2003-012092 | 1/2003 |
| JP | 2007-240117 | 9/2007 |
| JP | 2010-052752 | 3/2010 |
| JP | 2011-102154 | 5/2011 |

OTHER PUBLICATIONS

Written Opinion of the International Searching Authority issued Sep. 25, 2012 in International (PCT) Application No. PCT/JP2012/066860 (with English translation).

Extended European Search Report issued May 20, 2015 in corresponding European Application No. 12864302.0.

* cited by examiner

WATER DISPENSER

TECHNICAL FIELD

This invention relates to a water server (water dispenser) which can cool water in a tank and supply the thus cooled water as drinking water.

BACKGROUND ART

This type of water dispenser is configured such that when water stored in a cold water tank which is capable of cooling water therein runs short, water is automatically supplied into the tank through a water supply line, the water thus supplied is cooled by a heat exchanger mounted to the cold water tank, and cold water in the cold water tank can be discharged into the atmosphere through a cold water discharge line when a user operates a lever or a cock to open a valve. The closer water in the tank is to the bottom of the tank, the colder it is. If the water dispenser is configured such that water introduced into the cold water tank can directly flow down to the bottom of the tank, the not-yet-sufficiently-cooled water is quickly mixed with the well cooled water at the bottom of the tank, warming the water at the bottom of the tank. In order to prevent this, a baffle is usually provided in the cold water tank which interferes with the downward flow of water (see, e.g., JP Patent Publication 2010-52752A (especially FIG. 1), JP Patent Publication 2011-102154A (especially FIG. 1), and JP Patent Publication 2003-12092A (especially FIGS. 1 and 2)).

With this arrangement, a low-temperature water layer which is lower in temperature than water above the baffle is generated in the lower portion of the cold water tank which is within the height range from the bottom of the cold water tank to the outermost circumferential portion of the baffle, from the bottom of the tank. The cold water discharge line is arranged to discharge water forming the low-temperature water layer. If the outermost circumferential portion of the baffle is fitted to the inner wall of the cold water tank or by minimizing the horizontal gap therebetween, it is possible to increase the area of the baffle, which divides the interior of the cold water tank into upper and lower portions, thereby increasing the effect of interfering with the downward flow of water. But in this case, water above the baffle cannot sufficiently smoothly flow through the baffle into the lower portion of the cold water tank. To avoid this problem, the baffle may be formed with water transfer passages at its portion located inwardly of the outermost circumferential portion so that water introduced into the portion of the cold water tank from the water supply line can be fed into the lower portion of the cold water tank through the water transfer passages.

The water transfer passages have a terminal end opening which faces vertically downwardly, just like the gap defined between the inner wall of the cold water tank and the outermost circumferential portion of the baffle. Thus water is discharged through the terminal end openings substantially downwardly into the lower portion of the cold water tank. But since it is possible to reduce the momentum of water flowing through the water transfer passages by reducing the sectional areas of the leading end openings of the water transfer passages, it has not been considered a problem to discharge water downwardly from the terminal end openings of the water transfer passages.

However, if the gap between the inner wall of the cold water tank and the outermost circumferential portion of the baffle is eliminated or reduced to a minimum, while ensuring a sufficient flow rate of water through the baffle with a smaller number of water transfer passages, in order to mount the baffle more simply or to simplify the shape of the baffle, it is necessary to increase the sectional area of the respective water transfer passages over the entire length thereof. This increases the momentum of water when discharged downwardly into the lower portion of the cold water tank from the terminal end openings of the water transfer passages. Water discharged from the water transfer passages can thus be more easily mixed into the low-temperature water layer.

SUMMARY OF THE INVENTION

An object of the present invention is to make it more difficult for water discharged from the water transfer passages of the baffle to be mixed into the low-temperature water layer.

In order to achieve this object, at least one such water transfer passage is provided which has no portion extending in the vertical direction over the entire vertical length thereof, and is configured such that water is discharged into the lower portion of the cold water tank from the water transfer passage in a horizontal direction or a direction close to a horizontal direction. With this arrangement, since the water transfer passage has no portions extending in the vertical direction over the entire vertical length thereof, water flowing into the water transfer passage cannot flow down through the baffle in a straight line. Thus, even if the sectional area of the leading end opening of the water transfer passage is increased, the area of the surface of the baffle that divides the interior of the cold water tank into upper and lower portions does not decrease. By using the water transfer passage having no portion vertically extending over the entire vertical length thereof, the flow line of water flowing down in the water transfer passage can be bent such that water flows substantially in a horizontal direction by the time water reaches the terminal end opening. By further arranging the terminal end opening so as to face a direction perpendicular to a side view of the baffle, it is possible to discharge water from the terminal end openings of the water transfer passage into the lower portion of the cold water tank in a horizontal direction or a direction close to a horizontal direction. As used herein, "a direction close to a horizontal direction" refers to a direction inclined upwardly or downwardly relative to a horizontal direction by less than 45°. Water discharged from the water transfer passage in a horizontal direction or a direction close to a horizontal direction never flows down in the lower portion of the cold water tank in a straight line, but flows in a horizontal direction too. Thus such water flows a longer distance until it is mixed into the low-temperature water layer generated in the lower portion of the cold water tank from its bottom, so that such water is never easily mixed into the low-temperature water layer.

By providing the baffle with a plurality of such water transfer passages, it is possible to reduce the flow sectional areas of the respective water transfer passages, thereby reducing the momentum of water discharged into the lower portion of the cold water tank.

Preferably, the terminal end openings of the water transfer passages face a single common direction of rotation about a common vertical axis. With this arrangement, masses of water discharged from the respective water transfer passages never collide against each other, and flow down in the lower portion of the cold water tank, while moderately whirling therein. Thus, these masses of water are never easily mixed into the low-temperature water layer.

The at least one water transfer passage or each of the plurality of water transfer passages may comprise a downwardly recessed surface portion formed on the top surface of the baffle and having a distal edge, and an edge portion having a predetermined thickness and located over the distal edge so as to overlap the distal edge. With this arrangement, the recessed surface portion, which has no portion vertically extending over the entire vertical length thereof, deflects the downward flow of water in a horizontal direction or a direction close to a horizontal direction by the time water reaches the terminal end opening defined by the distal edge and the edge portion. Water is thus discharged through the terminal end opening, which opens in a direction perpendicular to a side view of the baffle, into the lower portion of the cold water tank in a horizontal direction or a direction close to a horizontal direction.

According to the present invention, in a water dispenser comprising a cold water tank configured to cool water stored in the cold water tank, a water supply line through which water is supplied into the cold water tank, a cold water discharge line extending from the cold water tank to the atmosphere, and a baffle configured to interfere with the downward flow of water introduced into the cold water tank from the water supply line, wherein the baffle has an outermost circumferential portion, wherein the cold water tank has a lower portion within a height range extending from a bottom of the cold water tank to the outermost circumferential portion, wherein the water dispenser is configured such that a low-temperature water layer is generated in the lower portion of the cold water tank, the low-temperature water layer being lower in temperature than water in the cold water tank above the baffle, and such that water forming the low-temperature water layer is discharged through the cold water discharge line, and wherein the baffle is formed with at least one water transfer passage at a portion of the baffle located inwardly of the outermost circumferential portion such that water introduced into the portion of the cold water tank above the baffle can flow through the water transfer passage into the lower portion of the cold water tank, the water transfer passage has no portion extending in the vertical direction over the entire vertical length thereof, and is configured such that water is discharged into the lower portion of the cold water tank from the water transfer passage in a horizontal direction or a direction close to a horizontal direction. With this arrangement, water discharged into the lower portion of the cold water tank from the water transfer passage of the baffle is never easily mixed into the low-temperature water layer.

DETAILED DESCRIPTION OF THE INVENTION

Figure 1:
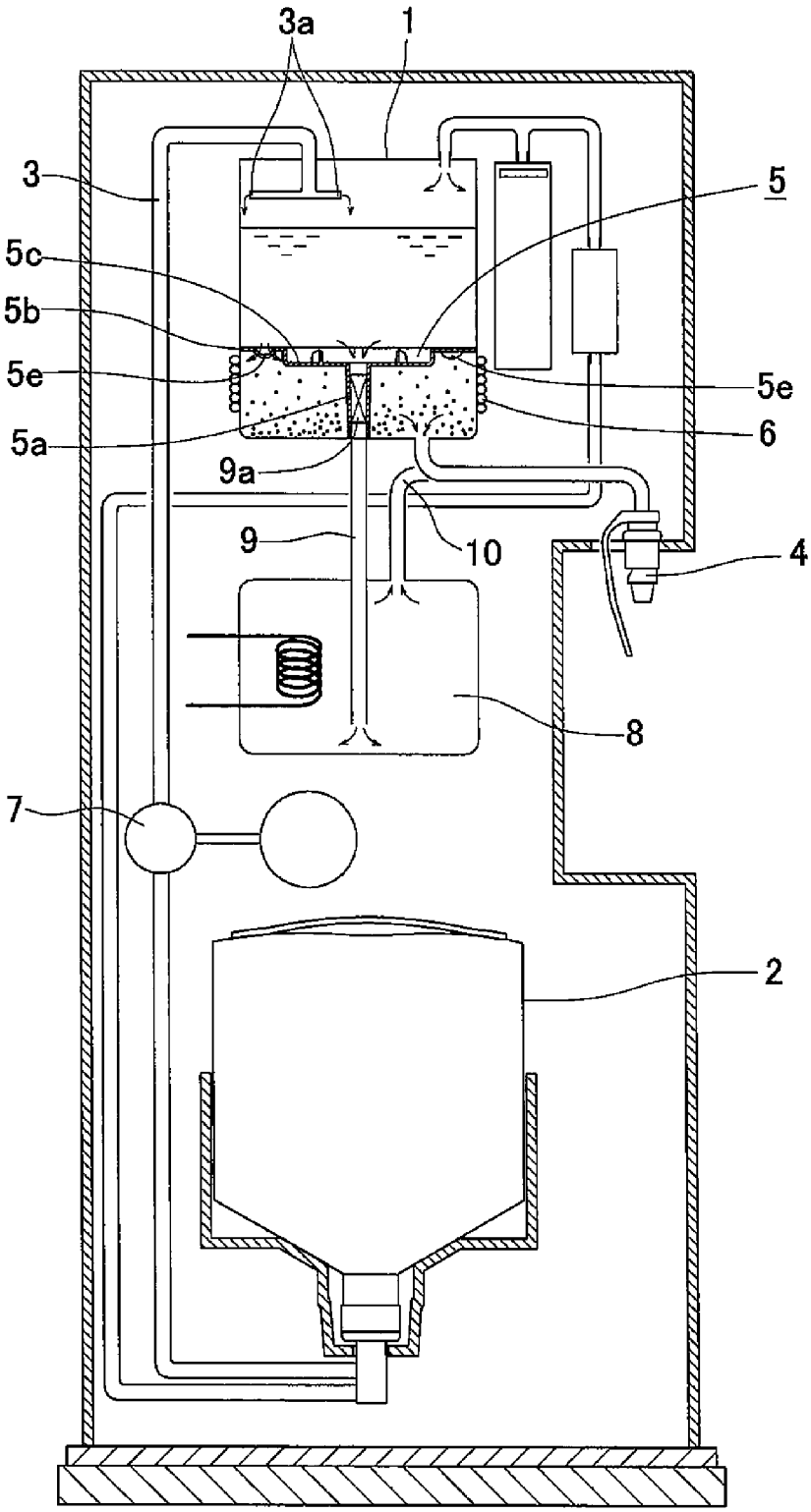
FIG. 1 schematically shows a water dispenser embodying the present invention in its entirety.
Figure 2:
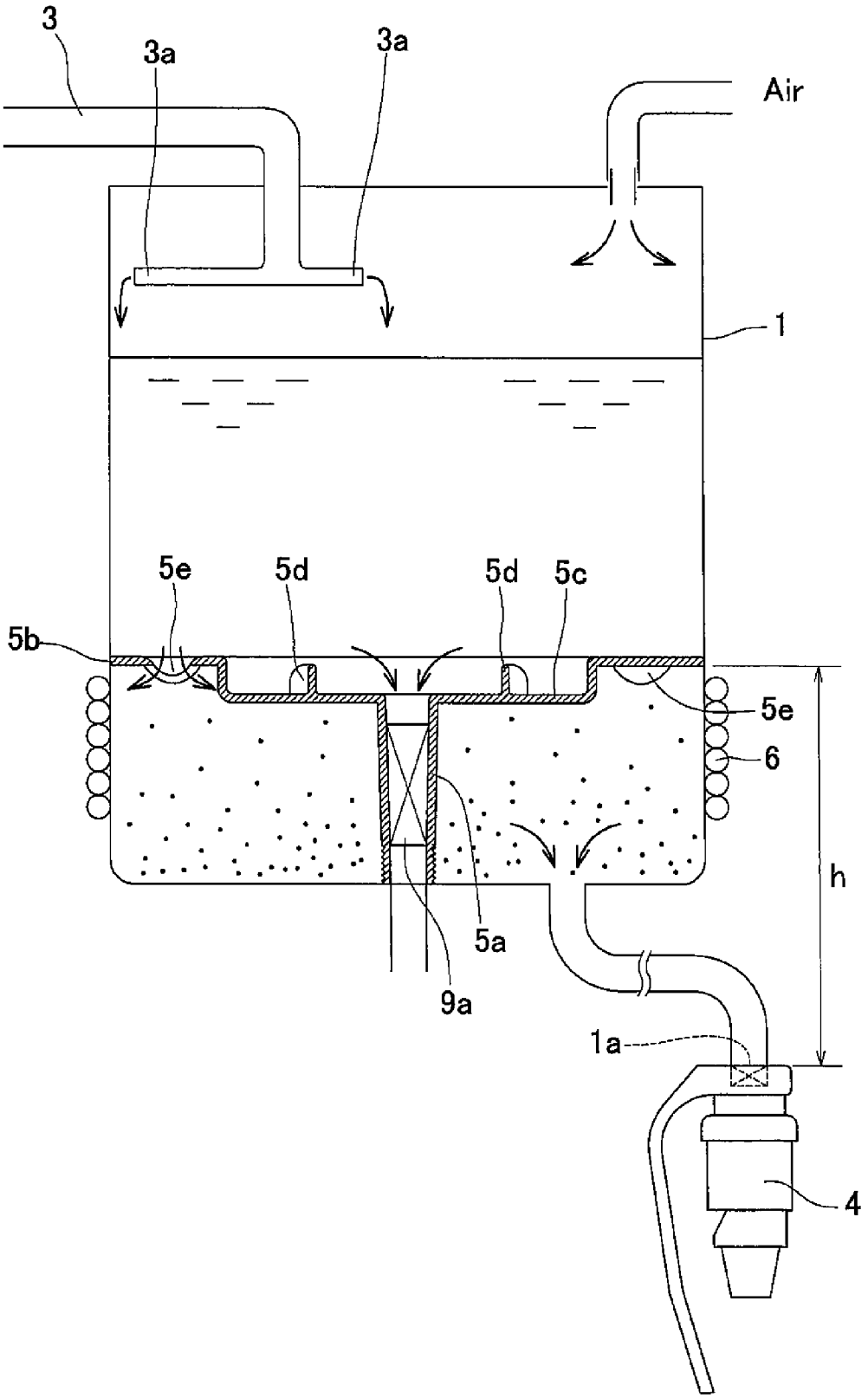
FIG. 2 is an enlarged view of a cold water tank of FIG. 1.
Figure 3:
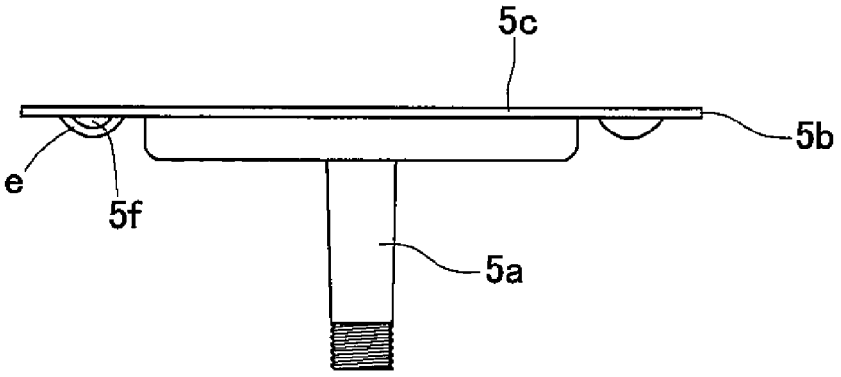
FIG. 3 is a front view of a baffle of the water dispenser of FIG. 1.

Now referring to the accompanying drawings, a water dispenser embodying the present invention is described. As shown in FIGS. 1 and 2, this water dispenser includes a cold water tank 1 which cools water stored therein, a water supply line 3 through which water is supplied from a raw water container 2 into the cold water tank 1, a cold water discharge line 4 extending from the cold water tank 1 to the atmosphere, and a baffle 5 which interferes with the downward flow of water introduced into the cold water tank 1 from the water supply line 3. Water in the raw water container 2 is fed into the cold water tank 1 through the water supply line 3, and water in the cold water tank 1 is cooled by a heat exchanger 6 mounted to the cold water tank 1. When a user opens a valve (not shown), cold water in the cold water tank 1 is fed through the cold water discharge line 4 and discharged into the atmosphere.

The heat exchanger 6 cools water in the cold water tank 1 by cooling the wall of the cold water tank 1.

The raw water container 2 is an exchangeable container. The raw water container 2 can be detachably set in a lower drawer of a housing of the water dispenser. Water may however be supplied to the cold water tank 1 from the public water supply.

The water supply line 3 is connected to the raw water container 2. Water in the raw water container 2 is drawn up through the water supply line 3 by a pump 7 and is discharged, in a shower or in droplets, into the cold water tank 1 through terminal ends 3*a* thereof located at a position higher than a predetermined upper limit water level in the cold water tank 1. Water in the raw water container 2 is supplied to the cold water tank 1 when a water level sensor detects that the water level in the cold water tank 1 is below a predetermined value. The raw water container 2 may be placed not at the lower portion of the housing but above the cold water tank 1. In this case, water in the raw water container 2 is fed by gravity into the cold water tank 1 through a shorter water supply line 3.

A user-operated on-off valve (shown schematically by phantom lines crossing each other in FIG. 2) is mounted in the cold water discharge line 4. Downstream of this valve, the cold water discharge line 4 has a discharge port through which water is discharged into the atmosphere.

The baffle 5 is detachably mounted to the cold water tank 1. The baffle 5 includes a vertical shaft portion 5*a* fixed to the bottom surface of the cold water tank 1. When the baffle 5 is removed, it is possible to clean the inner wall of the lower portion of the cold water tank 1 indicated by the letter h. The baffle 5 further includes a partition plate portion 5*c* extending horizontally from the vertical shaft portion 5*a* and having an outermost circumferential portion 5*b*. Only the partition plate portion 5*c* performs the function as the baffle 5, i.e. the function of interfering with the downward flow of water. The outermost circumferential portion 5*b* extends the entire circumference of the baffle 5 and is located on a single horizontal plane. If the baffle 5 is not fixed to the bottom surface of the cold water tank 1, the vertical shaft portion 5*a* may be omitted. The partition plate portion 5*c* is a plate member having no space extending through the partition plate portion in the vertical direction. During use, the outermost circumferential portion 5*b* is located closest to the inner wall of the cold water tank 1 and has the largest circumference of the baffle 5. Thus, the outermost circumferential portion 5*b* forms the horizontal outer limit portion of the baffle. The outermost circumferential portion 5*b* is sufficiently resistant to water pressure to be kept in engagement with the inner wall of the cold water tank 1 during use of the water dispenser. Instead of keeping the outermost circumferential portion 5*b* in engagement with the inner wall of the cold water tank 1, the outermost circumferential portion 5*b* may be mounted such that a gap is defined between outermost circumferential portion 5*b* and the inner wall of the cold water tank 1 over the entire circumference.

The gap has to be narrow enough that water discharged from the water supply line 3 does not flow into the gap in a straight line. With this arrangement, water above the baffle 5 can slowly flow down through the gap and reach the portion of the inner wall of the cold water tank 1 where there is the heat exchanger 6.

The heat exchanger 6 is provided at the lower portion of the cold water tank 1 at the height range from the bottom 1*a* of the cold water tank 1 to the outermost circumferential portion 5*b* of the baffle 5. As used herein, the word "height" refers to the height measured from the ground level. The bottom 1*a* of the cold water tank 1 refers to the lowest portion of the inner wall of the cold water tank 1. In the example shown, the bottom 1*a* of the cold water tank 1 is the upstream surface of the valve body of the valve which isolates the cold water tank 1 from the cold water discharge line 4 when the valve is closed. In FIG. 2, the lower portion h of the cold water tank 1 is indicated by double-headed arrow. The lower portion h of the cold water tank is within the height range of h. In the lower portion h, a low-temperature water layer, which is lower in temperature than water above the baffle 5, is generated from the bottom 1*a* due to the water cooling effect by the heat exchanger 6 and the water flow interfering effect by the baffle 5. The dots in FIGS. 1 and 2 indicate that the larger the number of dots per unit area, the lower the water temperature.

Since the cold water discharge line 4 is connected to the bottom 1*a* of the cold water tank, i.e. the lowest point of the lower portion h of the cold water tank, it is possible to discharge water forming the low-temperature water layer. The cold water discharge line 4 may not have to be connected to the cold water tank 1 at the same height of the bottom 1*a*, but is preferably connected to the cold water tank 1 at least at substantially the same height of the bottom 1*a* in order to discharge water forming the low-temperature water layer without a loss.

The water dispenser further includes a warm water tank 8 configured to heat water introduced into the tank 8 from the cold water tank 1, a connecting line 9 through which water in the cold water tank 1 above the baffle 5 is fed into the warm water tank 8, and a warm water discharge line 10 extending from the warm water tank 8 to the atmosphere. A valve 9*a* (schematically shown by solid lines crossing each other in FIGS. 1 and 2) is mounted in the vertical shaft portion 5*a* to isolate the connecting line 9 from the cold water tank 1 when the valve 9*a* is closed. With this arrangement, since water above the baffle 5, which is higher in temperature than water forming the low-temperature water layer, is supplied into the warm water tank 8 through the connecting line 9, water can be heated in the warm water tank 8 using less energy, even though water from the raw water container 2 is supplied only into the cold water tank and not into the warm water tank. By providing the heat exchanger 6 within a height range lower than the outermost circumferential portion 5*b* of the baffle 5, the heat exchanger 6 is not used to cool water above the baffle 5, thus further saving energy.

An external thread is formed on the outer periphery of the vertical shaft portion 5*a* of the baffle 5 at its lower portion, which external thread can be brought into threaded engagement with an internal thread formed in the bottom surface of the cold water tank 1. Grip portions 5*d* are formed on the top surface of the partition plate portion 5*c* which can be used to turn the baffle 5 to drive its vertical shaft portion into the bottom of the tank 1. If the water dispenser has no warm water supply function, or if the connecting line 9 is connected to the partition plate portion 5*c* through e.g. a separate tube, the baffle 5 may be detachably placed on or hooked to a shoulder portion of the cold water tank 1, thereby omitting the vertical shaft portion 5*a*.

Water transfer passages 5*e* are formed in the baffle 5 at its portion radially inwardly of the outermost circumferential portion 5*b*. Through the water transfer passages 5*e*, water supplied onto the baffle 5 from the water supply line 3 flows into the lower portion h of the cold water tank. As shown in FIGS. 3 to 8, each of the water transfer passages 5*e* has no portion extending in the vertical direction over the entire vertical length thereof and is configured such that water is discharged into the lower portion h of the cold water tank in a horizontal direction or in a direction close to a horizontal direction. Once water is discharged from the water transfer passages 5*e*, water flows freely toward the low-temperature water layer, and it is impossible to control the flow direction e.g. neither in the vertically downward direction nor in a horizontal direction.

Figure 9:
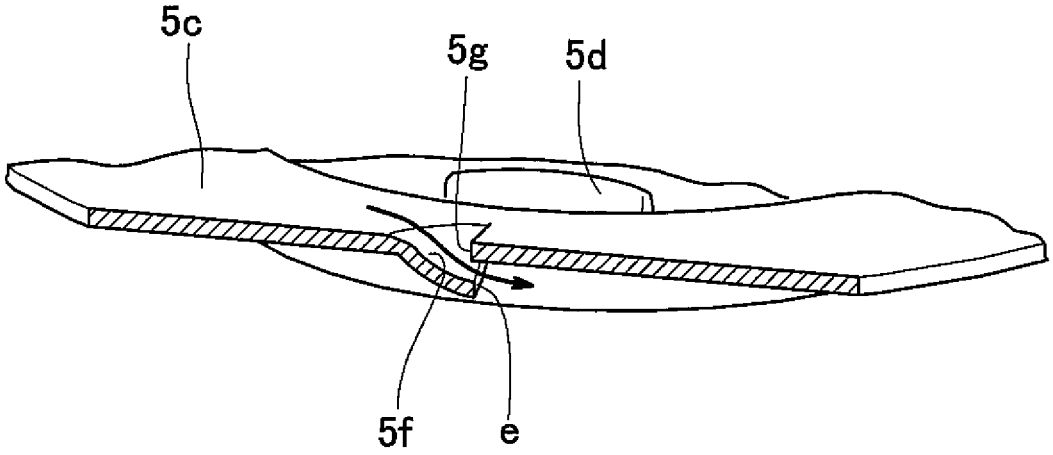
FIG. 9 schematically shows a flow line of water flowing in a water transfer passage of FIG. 3, when taken along a vertical plane.

Each of the water transfer passages 5*e* comprises a downwardly recessed surface portion 5*f* formed on the top surface of the partition plate portion 5*c* of the baffle 5, and an edge portion 5*g* having a predetermined thickness and located over the distal edge e of the recessed surface portion 5*f* so as to overlap with the distal edge e. The distal edge e is the distal edge of the inner surface of the water transfer passage 5*e* and protrudes into the lower portion h of the cold water tank in the horizontal and downward directions. The edge portion 5*g* is formed when the recessed surface portion 5*f* is formed and has a vertical thickness equal the thickness of the partition plate portion at this portion. Each of the water transfer passages 5*e* has a terminal end opening defined by the distal edge e and the edge portion 5*g* and opens only in the direction perpendicular to a side view of the baffle 5. The recessed surface portion 5*f* is made up of a plurality of curved surfaces including inclined curved surfaces extending upstream from the distal edge e and inclined upwardly at angles of less than 45° relative to a horizontal plane and also inclined such that water flowing down along the recessed surface portion 5*f* collects to the central lowest portion of the recessed distal edge e. When water flows into each water transfer passage 5*e* from above the baffle 5, as shown by the arrow in FIG. 9, its flow is deflected by the recessed surface portion 5*f*, which has no portion extending vertically over the entire vertical length thereof, in a horizontal direction or a direction close to a horizontal direction by the time water reaches the terminal end opening defined by the distal edge e and the edge portion 5*g*. Water is thus discharged through the terminal end openings of the respective water transfer passages into the lower portion h of the cold water tank in a horizontal direction or a direction close to a horizontal direction. Since it is impossible to control the flow direction of water once water is discharged from the water transfer passages 5*e*, the baffle 5 is preferably configured such that water discharged from the water transfer passages maintains its flow direction when discharged for as long a distance as possible. For this purpose, the baffle 5 has no portion located at the same height as, and facing, the terminal end opening of any water transfer passage 5*e*. The recessed surface portion 5*f* may not comprise curved surfaces but may comprise tapered surfaces, flat surfaces, vertical surfaces, etc.

Water discharged from the water transfer passages 5*e* in a horizontal direction or a direction close to a horizontal direction has a larger horizontal speed component than the vertical speed component, so that such water never flows downwardly in the lower portion h of the cold water tank, shown in FIG. 2, in a straight line, but flows a longer distance in a horizontal direction than vertically downwardly. Water discharged from the water transfer passages 5*e* thus flows a longer distance until it is mixed into the low-temperature water layer, than water discharged downwardly toward the lower portion of the cold water tank. Therefore, the water dispenser according to the present invention makes it more difficult for water discharged from the water transfer passages 5*e* to be mixed into the low-temperature water layer. In order to maximize the horizontal speed component of water discharged from the water transfer passages 5*e*, the water transfer passages 5*e* are arranged such that their terminal end openings substantially face horizontal directions.

The water transfer passages 5*e* may each comprise the partition plate portion 5*c* and a baffle forming component fitted on the partition plate portion 5*c*. With this arrangement, the water transfer passages 5*e* can be bent in a complicated manner, which makes it possible to reduce the flow speed of water by the time it reaches the terminal end openings.

As shown in FIGS. 3 to 8, the terminal end openings of all of the plurality of water transfer passages 5*e* face a single common direction of rotation about a common vertical axis. In the example shown, the vertical shaft portion 5*a* is the common vertical axis. With this arrangement, masses of water discharged from the respective water transfer passages 5*e* flow at the same height without colliding against each other. In particular, the masses of water flow down in the lower portion h of the cold water tank, shown in FIG. 2, while moderately whirling therein, as schematically shown by the arrows in FIG. 6. Thus, these masses of water flow a longer distance until they reach the low-temperature water layer, so that water discharged from the water transfer passages is never easily mixed into the low-temperature water layer.

In order to promote the whirling flow of water, the water transfer passages 5*e* are all arranged such that their terminal end openings face the cylindrical inner wall of the cold water tank 1 at the same height, with the cylindrical inner wall having a center axis coincident with the above-mentioned common vertical axis.

Figure 4:
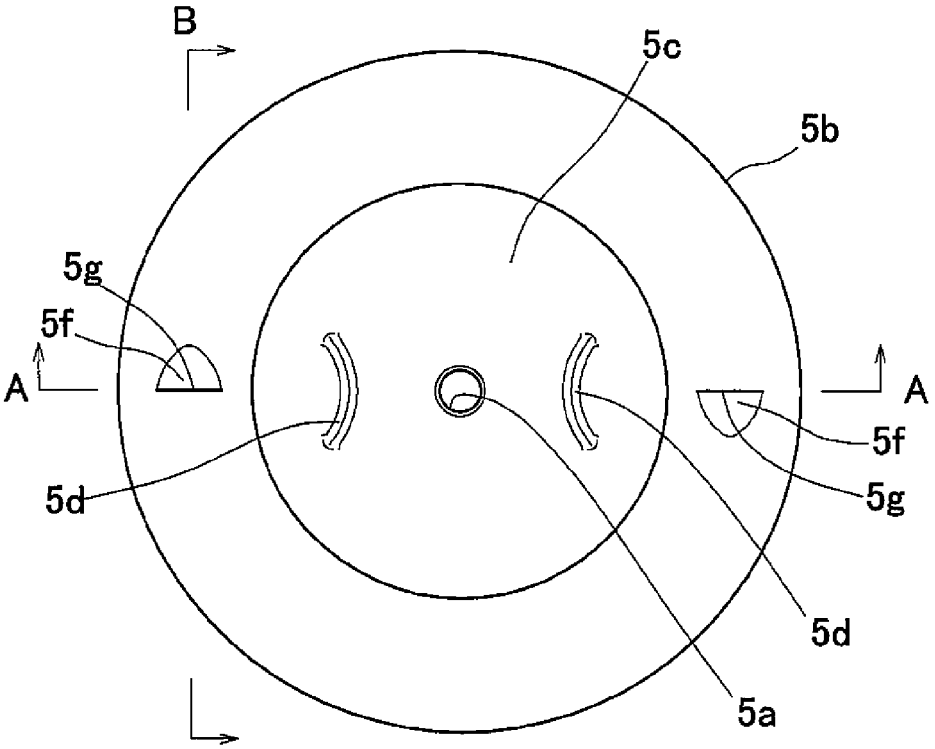
FIG. 4 is a top plan view of the baffle of FIG. 3.
Figure 5:
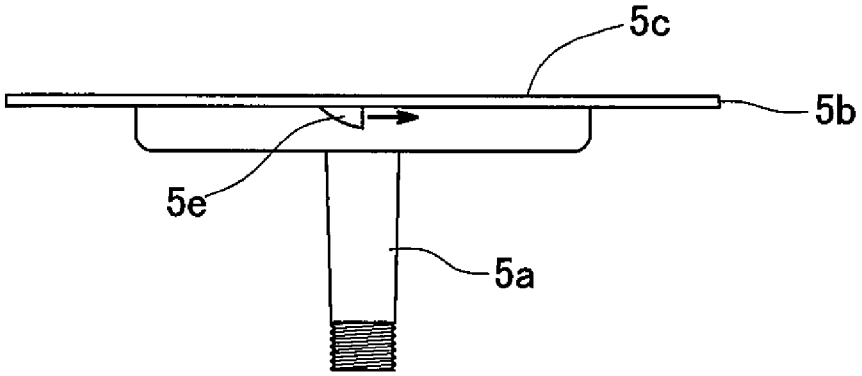
FIG. 5 is a side view of the baffle of FIG. 3.
Figure 6:
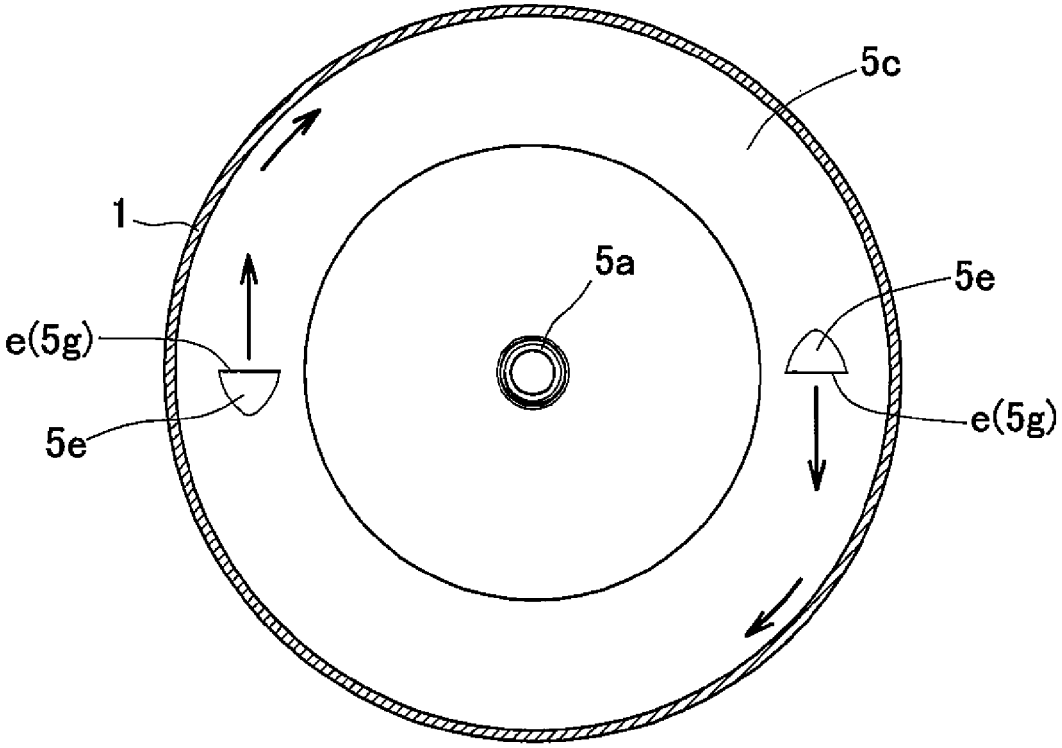
FIG. 6 shows a horizontal section of the inner wall of the cold water tank of this embodiment, and a partial section of the bottom surface of the baffle of FIG. 3.
Figure 7:
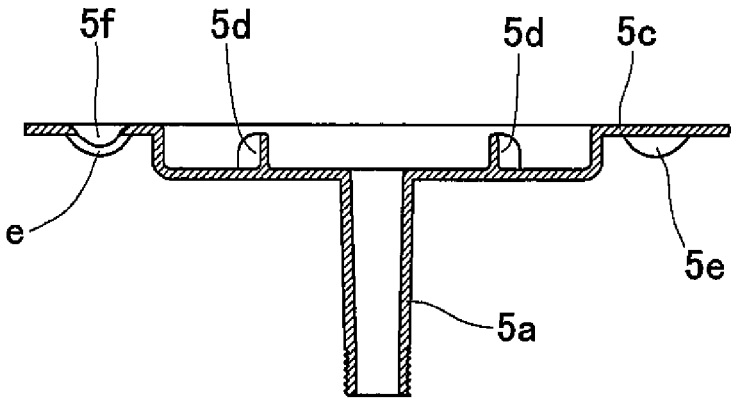
FIG. 7 is a sectional view taken along line A-A of FIG. 4.
Figure 8:
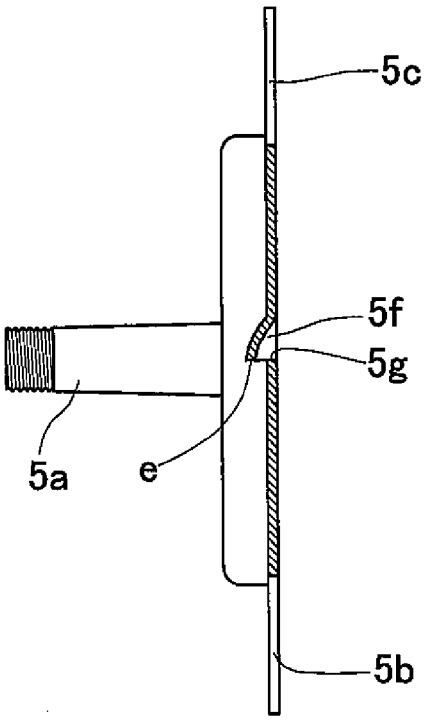
FIG. 8 is a sectional view taken along line B-B of FIG. 4.

The baffle 5 shown in FIGS. 3 to 8 has only two water transfer passages 5*e*, and has a rotational symmetry of 180° about the common axis (except the external thread of the vertical shaft portion 5*a*). The baffle 5 is a single monolithic member. The water transfer passages 5*e*, which each comprises the recessed surface portion 5*f* and the edge portion 5*g*, can be formed simultaneously when forming the monolithic baffle 5 by an upper mold for forming the top surface of the baffle 5 and horizontally separable lower molds for forming the bottom surface of the baffle, without forming undercuts. The distal edges e of the recessed surface portions 5*f*, which are located under the edge portion 5*g*, are formed by the lower molds, which are split in the direction in which the two water transfer passages are arranged. The vertical shaft portion 5*a*, which is formed with the external thread on the outer periphery, can also be formed by the lower molds. The baffle 5 is thus made of an injection moldable synthetic resin. But instead, the baffle may be made of a metal, and/or formed by pressing. The line A-A of FIG. 4 includes a diameter line of the outermost circumferential portion 5*b*. The line B-B of FIG. 4 represents a vertical plane which divides one of the water transfer passages 5*e* into two portions that are mirror images of each other.

The number and the arrangement of water transfer passages 5*e* are not limited to those shown. For example, if the outermost circumferential portion 5*b* is fitted to the inner wall of the cold water tank 1, a larger number of water transfer passages 5*e* may be provided to increase the flow rate of water through the baffle to a required level. But if the number of water transfer passages 5*e* is increased, it may become difficult to extend the distance by which water flows while whirling. Thus, instead of increasing the number of water transfer passages 5*e*, the flow sectional area of each of the two water transfer passages 5*e* may be increased to increase the flow rate of water to the required level. The present invention is not limited to the above-disclosed embodiments but is to be understood to encompass all of the variations and modifications that are within the range of the attached claims.

What is claimed is:

1. A water dispenser comprising a cold water tank configured to store cold water, a water supply line through which water is supplied into the cold water tank, a cold water discharge line extending from the cold water tank to an atmosphere, and a baffle configured to interfere with a downward flow of water introduced into the cold water tank from the water supply line, wherein the baffle has an outermost circumferential portion, wherein the cold water tank has a lower portion within a height range extending from a bottom of the cold water tank to the outermost circumferential portion, wherein the water dispenser is configured such that a low-temperature water layer is generated in the lower portion of the cold water tank, the low-temperature water layer being lower in temperature than water in the cold water tank above the baffle, and such that water forming the low-temperature water layer is discharged through the cold water discharge line, wherein the baffle is formed with water transfer passages at a portion of the baffle located inwardly of the outermost circumferential portion such that water introduced into a portion of the cold water tank above the baffle can flow through the water transfer passages into the lower portion of the cold water tank, wherein each of the water transfer passages has no portion extending in a vertical direction over a entire vertical length of said each water transfer passage, and is configured such that water is discharged into the lower portion of the cold water tank from said each water transfer passage in a horizontal direction or a direction close to a horizontal direction, and wherein the water transfer passages have terminal end openings, respectively, which face in a single common circumferential direction of rotation about a common vertical axis such that water discharged from the water transfer passages is discharged in the single common circumferential direction of rotation about the common vertical axis.

2. The water dispenser of claim 1, wherein each of the plurality of water transfer passages comprises a downwardly recessed surface portion formed on a top surface of the baffle and having a distal edge, and an edge portion having a predetermined thickness and located over the distal edge so as to overlap the distal edge.

* * * * *